United States Patent [19]

Morris et al.

[11] Patent Number: 4,505,189

[45] Date of Patent: Mar. 19, 1985

[54] VANDAL-RESISTANT AND TAMPER-PROOF PLENUM OR VACUUM CHAMBER SECURITY AIR FLOW ADJUSTMENT DEVICE

[75] Inventors: Earl L. Morris, La Habra Hts.; V. Walter Hafner, Whittier, both of Calif.

[73] Assignee: Acorn Engineering Company, Industry, Calif.

[21] Appl. No.: 455,752

[22] Filed: Jan. 5, 1983

[51] Int. Cl.[3] ..... F24F 7/00

[52] U.S. Cl. ..... 98/40.19; 98/108; 98/41.3

[58] Field of Search ..... 98/40 D, 40 C, 41 SV, 98/108; 49/160, 292, 449; 292/DIG. 46, 251; 251/112, 114; 137/358, 360

[56] References Cited

U.S. PATENT DOCUMENTS 2,792,771 5/1957 Burwen ..... 98/41 SV 3,124,903 3/1964 Truhan ..... 98/40 D X 4,426,918 1/1984 Lambert ..... 98/41 SV X

*Primary Examiner*—William E. Wayner

*Assistant Examiner*—John Sollecito

*Attorney, Agent, or Firm*—Edgar W. Averill, Jr.

[57] ABSTRACT

A vandal-resistant and tamper-proof plenum or vacuum chamber security air flow adjustment device installed inside the cabinet of a plumbing fixture. The device has a grille formed in the wall of the cabinet with many spaced openings therein and one surface of the grille is accessible from within a cell or other room and the back surface is inaccessible therefrom. A damper member is slidingly mounted against the inaccessible surface and is adjustable to control the amount of air flowing through the grille. The damper member has many openings which are spaced apart the same distance as the openings in the grille and the damper member is inaccessible from the cell but accessible from a pipe chase positioned on the other side of the cell wall.

9 Claims, 4 Drawing Figures

FIG. 1.
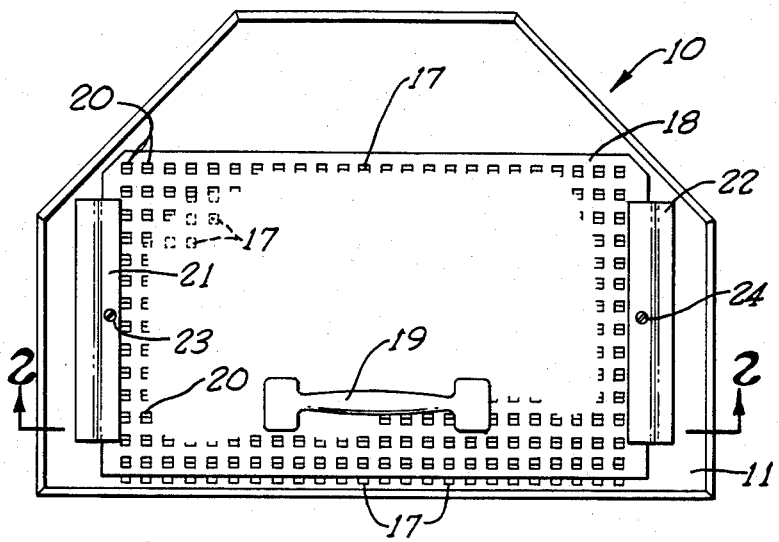
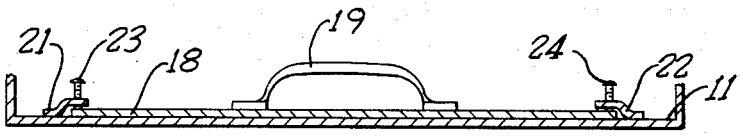
FIG. 2
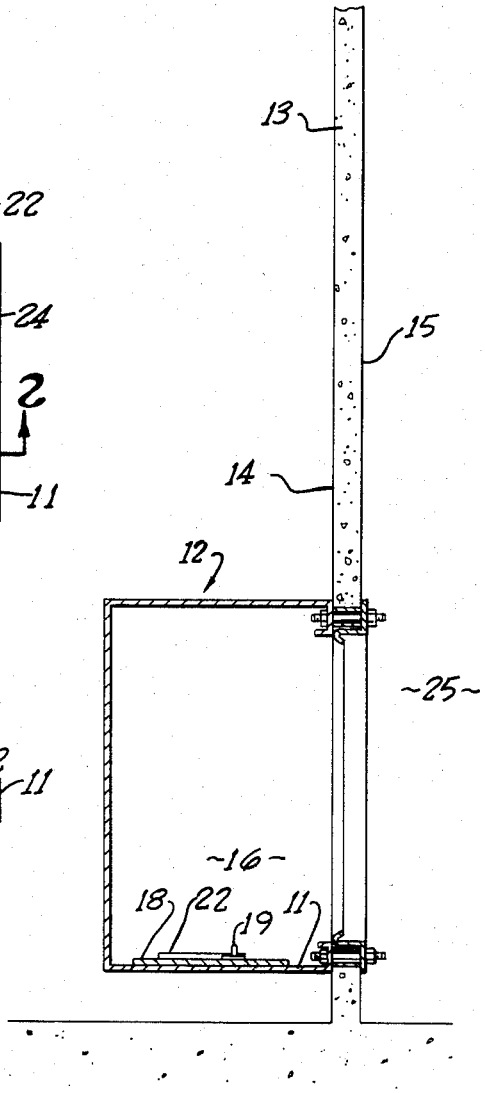
FIG. 4.
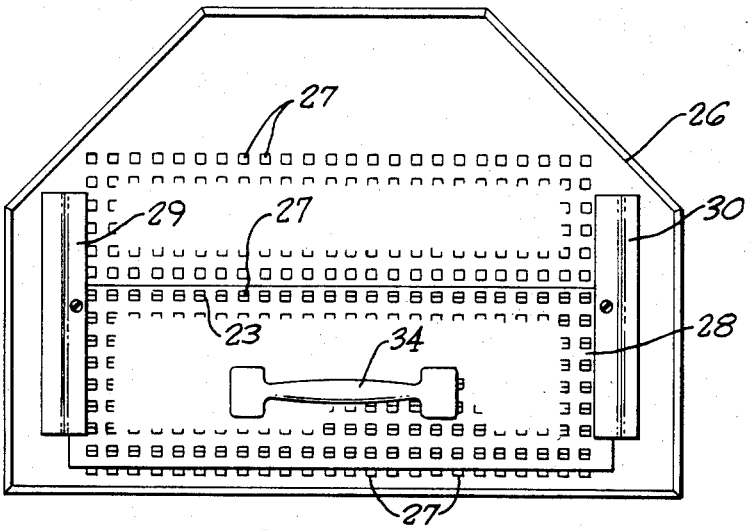
FIG. 3.

VANDAL-RESISTANT AND TAMPER-PROOF PLENUM OR VACUUM CHAMBER SECURITY AIR FLOW ADJUSTMENT DEVICE

CROSS REFERENCE TO RELATED APPLICATIONS

This application is being filed the same day as the following applications which are assigned to the assignee of the present application; U.S. Pat. No. 4,434,516 Wall Sleeve and Installation Jig for Multiple Adjacent Fixture Mounting; U.S. Pat. No. 4,480,163 Vandal Resistant Push Button Electrical Switch Assembly; Ser. No. 455,751 Plenum/Vacuum Chamber with Duct Connection for Installation in Cabinet Fixtures to Control Air Supply or Return; U.S. Pat. No. 4,453,202 Vandal Resistant Light Fixture; U.S. Pat. No. 4,492,430 Security Mirror Replaceable from Pipe Chase and Ser. No. 445,665 Vandal Resistant and Tamper-Proof Multi-Purpose Modular Lavatory/Toilet.

BACKGROUND OF THE DISCLOSURE

The field of the invention is air vents for vandal-resistant applications for directing the flow of air into or out of the room or cell. The invention relates more particularly to air vents useful in prison cells, mental institutions and other environments where it is necessary that the vent cannot be damaged or operated from within the cell or room which the vent is servicing.

Typically, in the past, in order to create a vandal-resistant air vent, the grate or grille across the surface of a conventional duct outlet was merely made from a stronger material and the air-flow adjustment if any was made by a damper installed in the supply line upstream of the grate or vent or was only adjustable from the cell. Adjustment from within the cell is disadvantageous because of numerous reasons. The steps required to provide maintenance service in a prison cell are labor intensive. First, it must be understood that prison guards or security personnel are not permitted to do service or maintenance work. Furthermore, maintenance personnel are not trained or equipped to guard prisoners. Still further, tools which are required to perform maintenance are potentially capable of being used as weapons and it thus becomes necessary for the maintenance personnel to be kept separated from the prisoners. Therefore, even for a simple maintenance task it is necessary to first remove the prisoner or prisoners from the cell. Secondly, the maintenance man, accompanied by a security man enter the cell. A second security man may also be required to escort the maintenance man to the cell door. It can thus be seen that a task as ostensibly simple as changing a light bulb becomes a disruptive and labor intensive task if it must be done from within the cell. These steps are eliminated when service can be performed from the pipe chase where an unescorted service man may do the work. Secondly, if the air flow can be adjusted from the cell the prisoner can disrupt the balance of air flow in other cells along the same duct by opening or closing the vent. In many institutions, it was believed not practical to provide for individual adjustment for each air outlet or inlet and the vent was merely operated in an open configuration. The ability to adjust the air flow in each room or cell is important to provide occupant comfort. Plumbing fixture cabinets have been used for air vent placement but such vents were not adjustable.

SUMMARY OF THE INVENTION

It is an object of the present invention to provide a vandal-resistant and tamper-proof plenum or vacuum chamber security air flow adjustment device which is adjustable from the exterior of the room in which it is placed and inaccessible from the interior thereof.

The present invention is for a vandal-resistant and tamper-proof plenum or vacuum chamber security air-flow adjustment device installed in the cabinet of a plumbing fixture having a grille with a plurality of spaced openings therein. The grille is formed in a wall of the cabinet and positioned to permit air transfer with respect to the room and the grille has a room directed surface and a back surface on the opposite side thereof. The back surface of the grille is inaccessible from the room but accessible from outside of the room as for instance from a pipe chase located on the other side of a wall in a cell. A damper member is slidingly mounted against the back surface of the grille and the damper member has two parallel sides and a plurality of openings positioned at locations which match locations of the openings through the grille. The damper member is held along its two parallel sides and is slidingly adjustable so that the amount of free space which is permitted to pass through the grille varies as the damper member is slidingly adjusted. Preferably, the openings in the damper member are of the same size as those in the grille. When the openings are spaced apart at least the distance equal to the size of the opening, the vent may be moved from its maximum open position to a completely closed position merely by a short movement of the damper which thus permits its use in applications where sliding movement of the damper is severely limited.

BRIEF DESCRIPTION OF THE DRAWINGS

FIG. 1 is a plan view of the air flow adjustment device of the present invention.

FIG. 2 is an end view of the device of FIG. 1.

FIG. 3 is a plan view of an alternate configuration of the device of the present invention.

FIG. 4 is a cross-sectional side view of a portion of a wall and floor of a prison cell.

DESCRIPTION OF THE PREFERRED EMBODIMENTS

The vandal-resistant and tamper-proof plenum or vacuum chamber security air flow adjustment device is shown in plan view in FIG. 1 and indicated generally by reference character 10. Vent 10 is shown installed in the floor 11 of a fixture 12 shown in FIG. 4. Fixture 12 may be a lavatory or other device typically fabricated from stainless steel which extends into a prison cell or other room. The cell wall 13 has a cell side 14 and a chase side 15. The chase is an area accessible to service personnel but inaccessible from inside of the cell. Wall 13 has an opening that permits service personnel to gain access to the interior 16 of fixture 12.

Returning to FIG. 1, vent 10 has a plurality of openings 17 punched or otherwise formed through floor 11 which is typically fabricated from stainless steel such as 14 gauge type 304 stainless steel. The openings may be of many sizes and shapes but square openings of $\frac{1}{4}$ inch sides and spaced apart by $\frac{1}{4}$inch have been found highly satisfactory. Vent 10 has a damper 18 which has a handle 19 and a plurality of openings 20. Damper 18 is slidingly held above floor 11 by a pair of channels 21 and 22. Channels 21 and 22 each have a tightening screw 23 and 24 threaded therethrough and the tightening of these screws against the damper holds the damper in the desired position.

As is evident from FIG. 4, the damper handle 19 is accessible from the pipe chase 25, and screws 23 and 24 can be loosened and the damper adjusted and then tightened to hold damper 18 in the position appropriate for properly ventilating the cell or room. Controlling the flow of air to individual rooms permits balancing the system for efficient heating or cooling.

The air flow adjustment device of the present invention can be used in confined quarters such as the floor of fixture 12 and by proper location of openings 17 and 20, the vent can be adjusted from a maximum open configuration to a maximum closed configuration merely by the small sliding movement of damper 18. As shown in FIG. 1, openings 17 are spaced at the same distance from each other as are openings 20. Openings 17 are also of the same size and spacing as openings 20 and therefore when they are oriented one above the other, the vent permits the maximum flow of air therethrough. When the damper 18 is moved the distance equal to the side of each opening 17, the vent goes from a maximum opened configuration to a maximum closed configuration.

As shown in FIG. 3 in some installations where it is not necessary to close off air completely, the damper may be of a smaller size. Thus, floor 26 has a plurality of square openings 27 some of which may be closed by movement of damper 28. Damper 28 is held in channels 29 and 30 and secured in place by screws 31 and 32. Openings 33 in damper 28 are located in the same relative location as the openings 27 in the floor so that each opening in the damper lies over a corresponding opening in the floor when the damper is so oriented. As above, handle 34 is used to facilitate the sliding of damper 28.

The air flow adjustment device, may, of course, be mounted in the wall 13 or in a side wall of fixture 12, in the top of the fixture or in any other appropriate location which is accessible from outside of the cell or room. Furthermore, the air flow adjustment device may be operated in a plenum where the air pressure is greater on the interior thereof than in the room or cell. Alternatively, when the vent is being used for return air from the cell, it may used in a vacuum chamber.

Thus, the result of the use of the air flow adjustment device of the present invention permits ready adjustment from outside of the cell without the necessity of personnel entering the cell which requires additional security in the case of a prison. It can also be seen that the device cannot be tampered with or adjusted from inside of the cell since the damper is held securely by its holding screws and is held on the inaccessible surface of the grille. Although the device shown in the drawings is indicated as having square openings, the openings, of course, may not be square and may be circular, triangular or other shapes. Furthermore, the openings in the damper need not be of identical size and shape as the openings in the floor and it is necessary only that the openings in the damper be located at the same respective position as the openings in the floor. Thus, the openings in the floor might be square and the openings in the damper triangular and the device would nonetheless be operative. The term "wall" as used herein is intended to include any wall of the cabinet of the fixture including the side walls, floor or top.

The present embodiments of this invention are thus to be considered in all respects as illustrative and not restricitve; the scope of the invention being indicated by the appended claims rather than by the foregoing description. All changes which come within the meaning and range of equivalency of the claims are intended to be embraced therein.

What is claimed is:

1. A vandal-resistant and tamper-proof plenum or vacuum chamber security air flow adjustment device, installed in the cabinet of a plumbing fixture, comprising:

a grille having a plurality of spaced openings therein, said grille being formed in a wall of the cabinet of a plumbing fixture and having a room-directed surface and a back surface on the opposite side thereof, the back side of said grille being inaccessible from the room but accessible from outside the room;

a damper member having an interior-facing surface and a mating surface which is slidingly mounted against the back surface of the grille, said damper member having two parallel sides, said damper member having a plurality of openings each opening matching in location an opening in said grille, said damper member being held along said two parallel sides by a pair of side brackets positioned beyond the extremity of said plurality of openings in said damper member and being slidingly adjustable so that the amount of free space which is permitted to pass through the grille varies as the damper member is slidingly adjusted; and tightening means held by at least one of said brackets and said tightening means being positioned so that it abuts a surface of said damper whereby when said tightening means is tightened, the damper is held in a fixed position.

2. The flow adjustment device of claim 1 further including handle means affixed to the interior-facing surface of said damper member.

3. The flow adjustment device of claim 1 wherein said spaced openings in said grille are of equal size and said damper member has a plurality of openings having the same size as those in the grille.

4. The flow adjustment device of claim 2 wherein said openings are square openings.

5. The flow adjustment device of claim 3 wherein said openings are spaced apart a distance equal to the side dimension of each of said square openings whereby when said damper is moved a distance equal to the side dimension of each of said openings, the air flow through said grille is adjusted from its maximum to its minimum amount.

6. The air flow adjustment device of claim 1 wherein said damper is held by a pair of side brackets positioned beyond the extremity of said plurality of openings.

7. The air flow adjustment device of claim 1 wherein said tightening means is a tightening screw.

8. The air flow adjustment device of claim 1 wherein each of said brackets has tightening means held thereby.

9. The air flow adjustment device of claim 8 wherein each of said brackets has a tightening screw passing therethrough.

* * * * *